US010286680B2

(12) United States Patent
Ishii

(10) Patent No.: US 10,286,680 B2
(45) Date of Patent: May 14, 2019

(54) THERMAL HEAD AND THERMAL PRINTER

(71) Applicant: KYOCERA Corporation, Kyoto-shi, Kyoto (JP)

(72) Inventor: Yoshinobu Ishii, Omihachiman (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/771,311

(22) PCT Filed: Oct. 27, 2016

(86) PCT No.: PCT/JP2016/081909
§ 371 (c)(1),
(2) Date: Apr. 26, 2018

(87) PCT Pub. No.: WO2017/073681
PCT Pub. Date: May 4, 2017

(65) Prior Publication Data

US 2019/0061371 A1 Feb. 28, 2019

(30) Foreign Application Priority Data

Oct. 29, 2015 (JP) ..... 2015-213065

(51) Int. Cl.
*B41J 2/335* (2006.01)

(52) U.S. Cl.
CPC ..... *B41J 2/3353* (2013.01); *B41J 2/3351* (2013.01); *B41J 2/33515* (2013.01)

(58) Field of Classification Search
CPC ..... B41J 2/3353; B41J 2/3351; B41J 2/33515
See application file for complete search history.

(56) References Cited

FOREIGN PATENT DOCUMENTS

JP 01-283163 A * 11/1989
JP 2000-141729 A 5/2000

OTHER PUBLICATIONS

Computer-generated translation of JP 01-283163, published on Nov. 1989.*

* cited by examiner

*Primary Examiner* — Huan H Tran
(74) *Attorney, Agent, or Firm* — Volpe and Koenig, P.C.

(57) ABSTRACT

A thermal head of the present disclosure includes a substrate; a heat generating section disposed on the substrate; an electrode which is disposed on the substrate and is connected to the heat generating section; a protective layer covering the heat generating section and the electrode, the protective layer having a surface provided with a depression portion; at least one particle of metal disposed inside the depression portion; and an oxide layer covering the at least one particle, the oxide layer being formed of oxides of the metal. A surface of the oxide layer is exposed to an outside and is located in a deeper position of the depression portion than the surface of the protective layer around the depression portion.

11 Claims, 6 Drawing Sheets

THERMAL HEAD AND THERMAL PRINTER

TECHNICAL FIELD

The present invention relates to a thermal head and a thermal printer.

BACKGROUND ART

In the related art, various thermal heads have been proposed as printing devices such as facsimiles or video printers. For example, there is known a thermal head comprising a substrate, a heat generating section disposed on the substrate, an electrode which is disposed on the substrate and is connected to the heat generating section, and a protective layer covering the heat generating section and the electrode and having a surface provided with a depression portion (see Patent Literature 1).

CITATION LIST

Patent Literature

Patent Literature 1: Japanese Unexamined Patent Publication JP-A 2000-141729

SUMMARY OF INVENTION

A thermal head of the present disclosure comprises a substrate, a heat generating section, an electrode, a protective layer, a particle of metal, and an oxide layer. The heat generating section is disposed on the substrate. The electrode is disposed on the substrate and is connected to the heat generating section. The protective layer covers the heat generating section and the electrode, and includes a surface provided with a depression portion. The particle of metal is disposed inside the depression portion. The oxide layer covers the particle of metal, and is formed of oxides of the metal. In addition, a surface of the oxide layer is exposed to an outside and is located in a deeper position of the depression portion than the surface of the protective layer around the depression portion.

A thermal printer of the present disclosure comprises the thermal head described above, a conveyance mechanism which conveys a recording medium so as to pass over the heat generating section, and a platen roller which presses the recording medium.

DESCRIPTION OF EMBODIMENTS

When the thermal head of the related art is driven, there occurs sticking in which the recording medium temporality sticks to the thermal head in some cases. It has been known that the sticking is likely to occur in a case where the contact area between the recording medium and the thermal head is large. Therefore, a thermal head is suggested in which sticking is prevented such that irregularities are formed on the surface of the protective layer protecting the surface of the thermal head to reduce the contact area between the recording medium and the protective layer. However, since the irregularities wear as the thermal head is used, it has not been possible to suppress the occurrence of sticking over a long period.

According to the thermal head of the present disclosure, it is possible to reduce the occurrence of sticking. Hereinafter, a thermal head and a thermal printer using the same of the present disclosure will be described in detail.

First Embodiment

Figure 1:
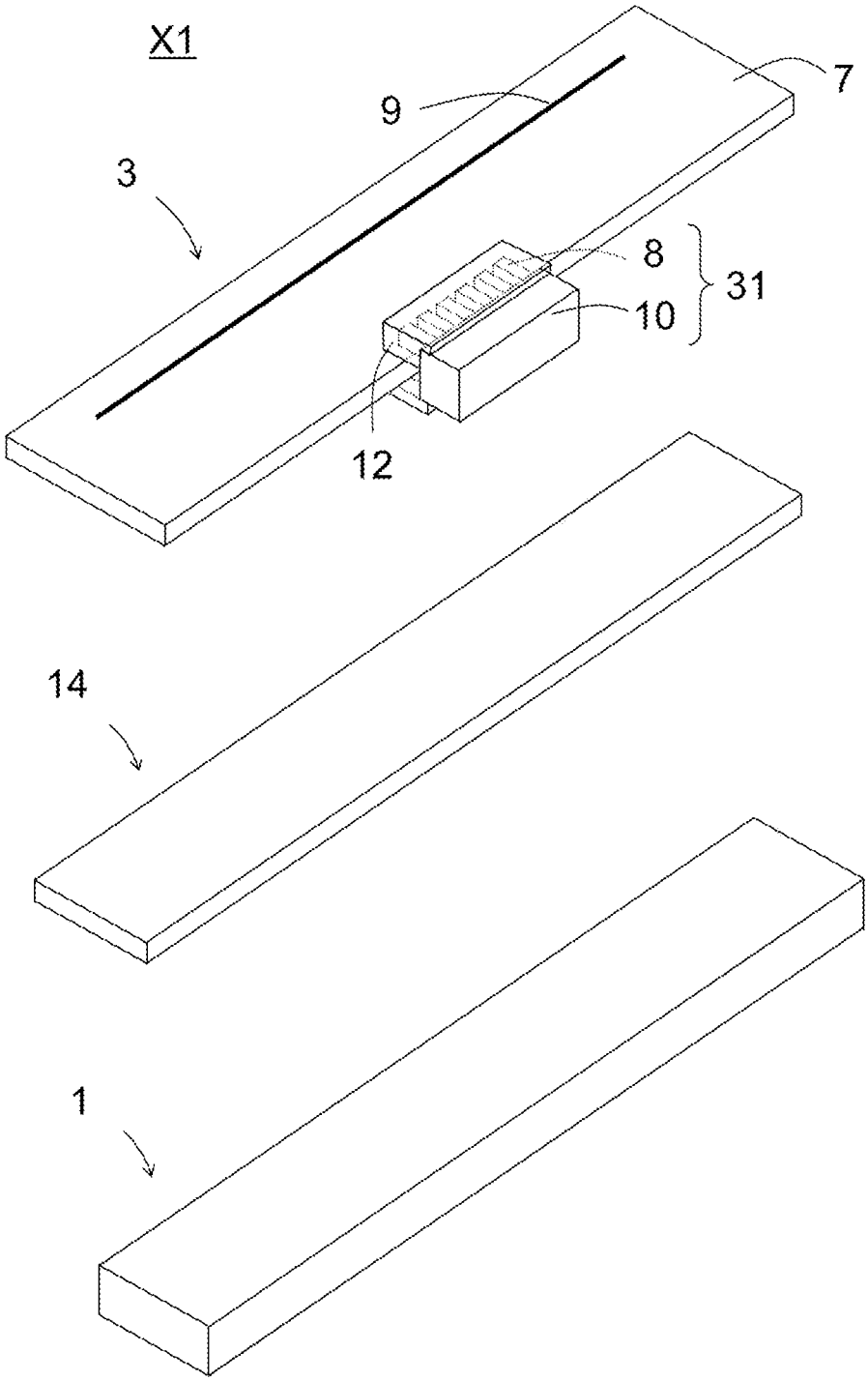
FIG. 1 is an exploded perspective view illustrating an outline of a thermal head according to a first embodiment.
Figure 2:
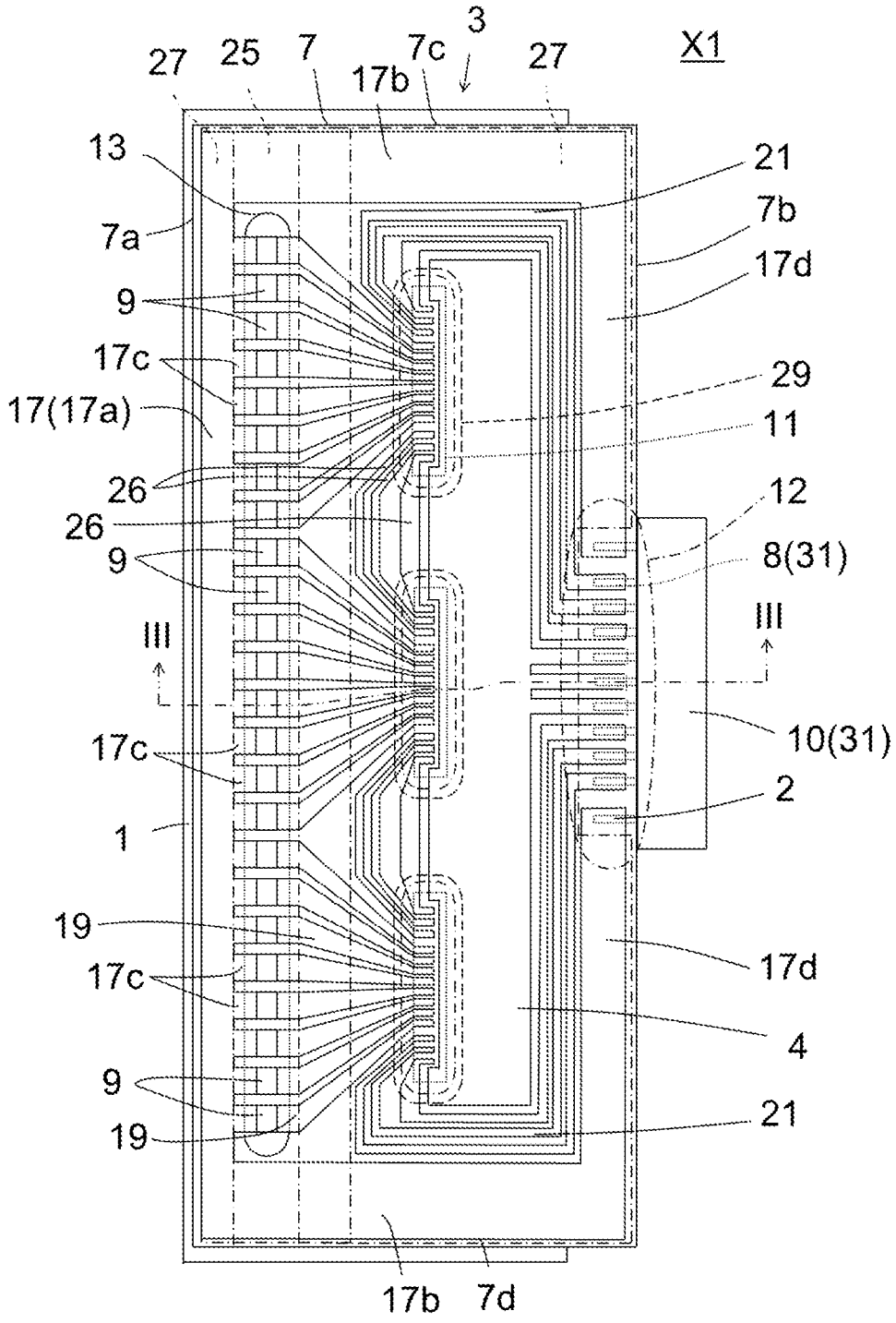
FIG. 2 is a plan view illustrating a schematic configuration of the thermal head illustrated in FIG. 1.
Figure 3:
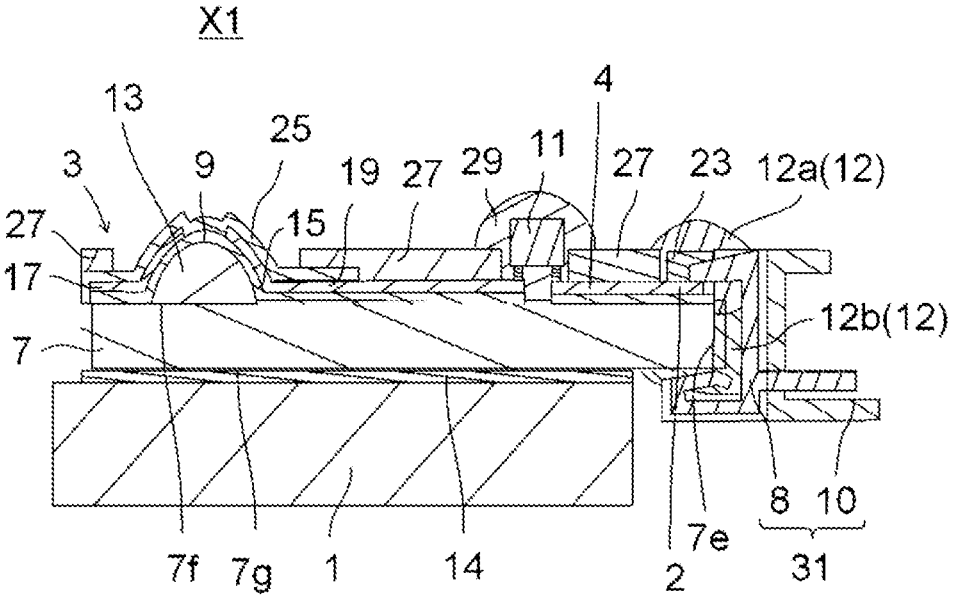
FIG. 3 is a sectional view taken along the line of FIG. 2.

Hereinafter, a thermal head X1 will be described with reference to FIGS. 1 to 4. FIG. 1 schematically illustrates a configuration of the thermal head X1. In FIG. 2, a protective layer 25, a cover layer 27, and a sealing member 12 are indicated by one-dot chain lines. In FIG. 3, illustration of an insulating layer 20 is omitted.

The thermal head X1 includes a head base body 3, a connector 31, a sealing member 12, a heat dissipating plate 1, and a bonding member 14. The heat dissipating plate 1 is configured to dissipate the heat of the head base body 3. The head base body 3 is mounted on the heat dissipating plate 1 with the bonding member 14 interposed therebetween. When a voltage is externally applied, the head base body 3 causes a heat generating section 9 to generate heat to perform printing on a recording medium (not illustrated). The bonding member 14 bonds the head base body 3 and the heat dissipating plate 1. The connector 31 electrically connects the head base body 3 to the outside. The connector 31 includes connector pins 8 and a housing 10. The sealing member 12 joins the connector 31 and the head base body 3.

The heat dissipating plate 1 has a rectangular shape. The heat dissipating plate 1 is, for example, formed of a metal material such as copper, iron, or aluminum, and has a function of dissipating heat which does not contribute to printing of the heat generated by the heat generating section 9 of the head base body 3.

The head base body 3 has a rectangular shape in a plan view, wherein respective members forming the thermal head X1 are disposed on the substrate 7. The head base body 3 performs printing on a recording medium (not illustrated) in accordance with an electric signal supplied from the outside.

Members forming the head base body 3 will be described with reference to FIGS. 1 to 3.

The substrate 7 is disposed on the heat dissipating plate 1 and has a rectangular shape in a plan view. The substrate 7 includes a first long side 7*a*, a second long side 7*b*, a first short side 7*c*, a second short side 7*d*, a side surface 7*e*, a first surface 7*f*, and a second surface 7*g*. The side surface 7*e* is disposed on a side of the connector 31. Members forming the head base body 3 are disposed on the first surface 7*f*. The second surface 7*g* is disposed on a side of the heat dissipating plate 1. The substrate 7 is, for example, formed of an electrically insulating material such as alumina ceramics or a semiconductor material such as monocrystalline silicon.

A heat storage layer 13 is disposed on the first surface 7*f* of the substrate 7. The heat storage layer 13 protrudes from the substrate 7 upward to form a bulge. The heat storage layer 13 extends along a main scanning direction. The cross-sectional shape of the heat storage layer 13 is such a shape that an ellipse is halved. In addition, the heat storage layer 13 functions to make a recording medium P (not illustrated) to be printed come into good contact with the protective layer 25 formed on the heat generating section 9. The heat storage layer 13 has a height of 15 to 90 μm from the substrate 7.

The heat storage layer 13 is formed of glass with low thermal conductivity and temporarily stores part of the heat generated by the heat generating section 9. Therefore, in the thermal head X1, a time necessary to increase the temperature of the heat generating section 9 is shortened, thereby improving thermal responsiveness. The heat storage layer 13 is formed, for example, by applying a predetermined glass paste to the upper surface of the substrate 7 by known screen printing or the like of the related art and firing the applied glass paste at high temperature, the predetermined glass paste being obtained by mixing an appropriate organic solvent with glass powder.

An electrical resistance layer 15 is disposed on the substrate 7 and the heat storage layer 13, and various electrodes forming the head base body 3 are disposed on the electrical resistance layer 15. The electrical resistance layer 15 includes exposed regions in which the electrical resistance layer 15 is exposed from between a common electrode 17 and discrete electrodes 19. The respective exposed regions form the heat generating sections 9, and are arranged in rows on heat storage layer 13. The electrical resistance layer 15 may be disposed in only between the common electrode 17 and the discrete electrode 19.

The plurality of heat generating sections 9, while being illustrated in simplified form in FIG. 2 for convenience in explanation, are arranged at a density of 100 dpi (dot per inch) to 2400 dpi, for example. The electrical resistance layer 15 is formed of a material having a relatively high electrical resistance value such for example as a TaN-based material, a TaSiO-based material, a TaSiNO-based material, a TiSiO-based material, a TiSiCO-based material, or a NbSiO-based material. Hence, upon application of a voltage to the heat generating section 9, the heat generating section 9 generates heat under Joule heating effect.

The common electrode 17 comprises: main wiring portions 17*a* and 17*d*; sub wiring portions 17*b*; and lead portions 17*c*. The common electrode 17 electrically connects the plurality of heat generating sections 9 to the connector 31. The main wiring portion 17*a* extends along the first long side 7*a* of the substrate 7. The sub wiring portions 17*b* extend along the first short side 7*c* and the second short side 7*d*, respectively, of the substrate 7. The lead portions 17*c* extend from the main wiring portion 17*a* toward the corresponding heat generating sections 9 on an individual basis. The main wiring portion 17*d* extends along the second long side 7*b* of the substrate 7.

The plurality of discrete electrodes 19 provide electrical connection between the heat generating section 9 and a driving IC 11. Moreover, the plurality of heat generating sections 9 fall into a plurality of groups, and the discrete electrodes 19 provide electrical connection between each heat generating section 9 group and corresponding one of the driving ICs 11 assigned one to each group.

A plurality of first connection electrodes 21 provides electrical connection between the driving IC 11 and the connector 31. The plurality of first connection electrodes 21 connected to the corresponding driving ICs 11 are composed of a plurality of wiring lines having different functions.

A ground electrode 4 is surrounded by the discrete electrodes 19, the first connection electrode 21, and the main wiring portion 17*d* of the common electrode 17. The ground electrode 4 is connected at a ground potential of 0 to 1 V.

Connection terminals 2 are disposed on a side of the second long side 7*b* of the substrate 7 in order to connect the common electrode 17, the first connection electrode 21, and the ground electrode 4 to the connector 31. The connection terminals 2 are disposed corresponding to the connector pins 8 of the connector 31, and are respectively connected to the connector pins 8 of the connector 31.

A plurality of second connection electrodes 26 electrically connects adjacent driving ICs 11. The plurality of second connection electrodes 26 are each disposed corresponding to the first connection electrode 21 and transmit various signals to the adjacent driving ICs 11.

The various electrodes forming the head base body 3 are formed, for example, by sequentially stacking respective material layers on the heat storage layer 13 by means of, for example, a thin film forming technology such as a sputtering method and subsequently processing a stacked body into a predetermined pattern by a known photoetching or the like of the related art. The various electrodes forming the head base body 3 can be simultaneously formed by the same process.

As illustrated in FIG. 2, the driving ICs 11 are disposed corresponding to each group of the plurality of heat generating sections 9 and are connected to the discrete electrodes 19 and the first connection electrode 21. The driving IC 11 has a function of controlling a conductive state of each heat generating section 9. As the driving IC 11, for example, a switching IC including a plurality of switching elements thereinside may be used.

The driving ICs 11 are sealed by a hard coat 29 in a state where the driving ICs are connected to the discrete electrodes 19, the second connection electrodes 26, and the first connection electrodes 21, the hard coat being formed of a resin such as an epoxy resin or a silicone resin.

On the heat storage layer 13 provided on the first surface 7*f* of the substrate 7, there is formed an insulating layer 20 which covers the heat generating section 9, a part of the common electrode 17, and a part of the discrete electrodes 19.

The insulating layer 20 is disposed on the heat generating section 9, on the part of the common electrode 17, and on the part of the discrete electrode 19. The insulating layer 20 is formed of a material with small resistivity, for example, $SiO_2$, SiN, or SiON can be used. The insulating layer 20 may have a thickness of 0.1 to 10 μm, for example.

By providing the insulating layer 20, the plurality of heat generating sections 9 arranged in the main scanning direction are insulated to each other. The insulating layer 20 can be formed by, for example, a screen printing method, a sputtering method, or an ion plating method.

The protective layer 25 protects regions in which the heat generating sections 9, the common electrode 17, and the discrete electrodes 19 are covered against corrosion caused due to attachment of moisture contained in the air or abrasion caused due to contact with a recording medium to be printed.

On the substrate 7 is disposed a cover layer 27 which partially covers the common electrode 17, the discrete electrodes 19, and the first connection electrode 21. The cover layer 27 protects regions in which the common electrode 17, the discrete electrodes 19, the second connection electrodes 26, and the first connection electrodes 21 are covered against oxidation due to contact with the air or corrosion caused due to attachment of moisture contained in the air. The cover layer 27 can be formed of a resin material such as an epoxy resin, a polyimide resin, or a silicone resin.

The connector 31 and the head base body 3 are fixed to each other by the connector pins 8, a conductive material 23, and the sealing member 12. The conductive material 23 is disposed between the connection terminals 2 and the connector pins 8, and for example, solder or anisotropic conductive paste (ACP) can be exemplified. A plating layer (not illustrated) may be provided between the conductive material 23 and the connection terminals 2, the plating layer being formed of Ni, Au, or Pd. The conductive material 23 may not be necessarily provided.

The connector 31 includes the plurality of connector pins 8 and the housing 10 accommodating the plurality of connector pins 8. The plurality of connector pins 8 have first ends and second ends, respectively. The first end is exposed to the outside of the housing 10, and the second end is accommodated in the housing 10. The first end of the connector pin 8 is electrically connected to the connection terminal 2 of the head base body 3. Therefore, the connector 31 is electrically connected to the various electrodes of the head base body 3.

The sealing member 12 includes a first sealing member 12*a* and a second sealing member 12*b*. The first sealing member 12*a* is located on the first surface 7*f* of the substrate 7, and the second sealing member 12*b* is located on the second surface 7*g* of the substrate 7. The first sealing member 12*a* is disposed so as to seal the connector pins 8 and the various electrodes. The second sealing member 12*b* is disposed so as to seal contact portions of the connector pins 8 and the substrate 7.

The sealing member 12 is disposed so as not to expose the connection terminal 2 and the connector pin 8 to the outside and may be formed of a thermosetting epoxy resin, an ultraviolet-curable resin, or a visible light-curable resin, for example. The first sealing member 12*a* and the second sealing member 12*b* may be formed either of the same material or of different materials.

The bonding member 14 is disposed on the heat dissipating plate 1 and bonds the second surface 7*g* of the head base body 3 to the heat dissipating plate 1. As the bonding member 14, a double-sided tape or a resinous adhesive can be exemplified.

Figure 4A:
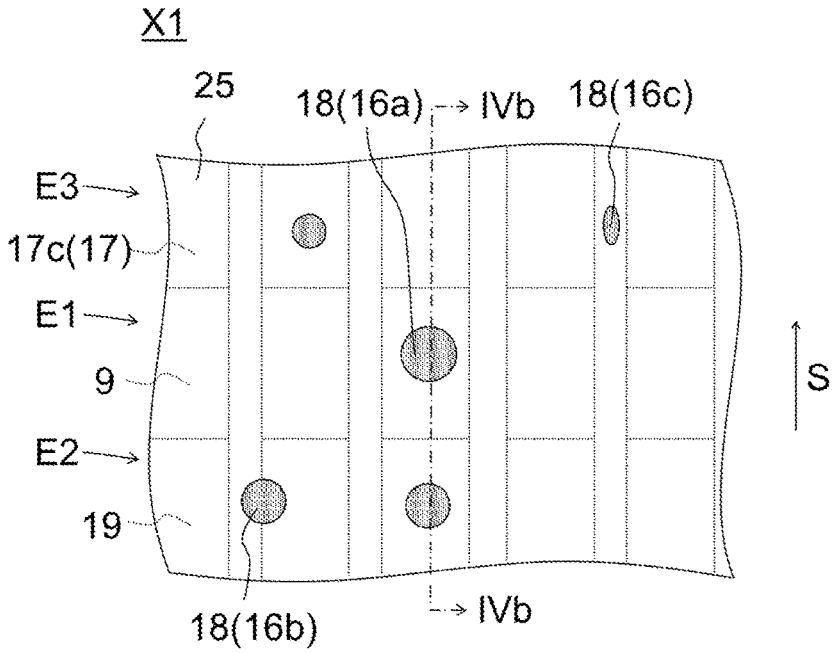
FIG. 4A is a plan view schematically illustrating the vicinity of a protective layer of the thermal head of FIG. 1.
Figure 4B:
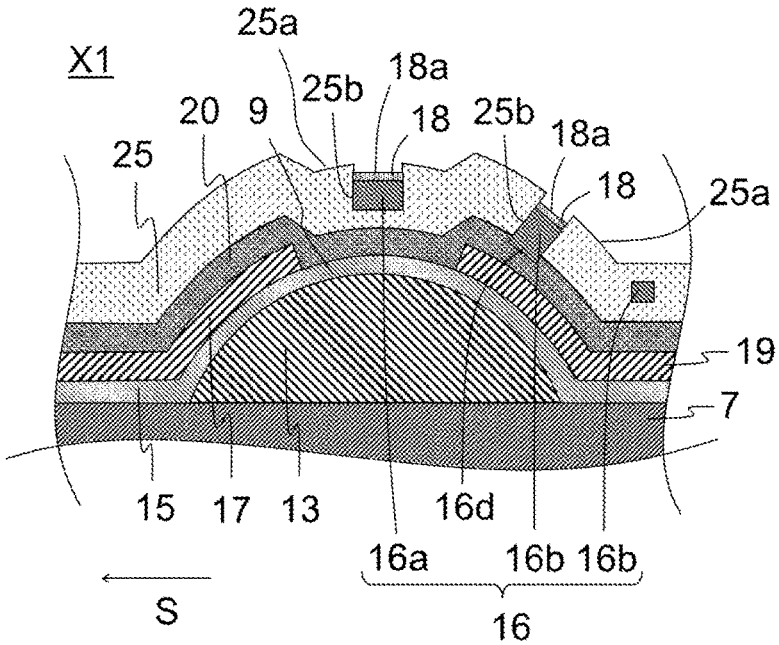
FIG. 4B is a sectional view taken along the line IVb-IVb of FIG. 4A.

The protective layer 25 and metal particles 16 will be described in detail with reference to FIGS. 4A and 4B.

The protective layer 25 is disposed on the insulating layer 20 and formed in an identical region to the insulating layer 20 in a plan view. The protective layer 25 is formed of a material with smaller resistivity than the insulating layer 20, and for example, TiN, TiCN, SiC, SiON, SiN, TaN, or TaSiO can be used.

The protective layer 25 can have a thickness of, for example, 2 to 15 μm. By providing the protective layer 25, a static electricity generated due to contact between the protective layer 25 and a recording medium can be eliminated. The protective layer 25 can be formed by, for example, a sputtering method or an ion plating method. In addition, the insulating layer 20 is formed by a sputtering method or an ion plating method, and the protective layer 25 may be formed successively.

The protective layer 25 includes a surface 25*a* provided with a plurality of depression portions 25*b*. The depression portion 25*b* has a circular shape or an elliptical shape in a plan view, and has a cylindrical shape and an elliptical cylindrical shape. Note that the depression portion 25*b* may have a polygonal columnar shape or a spherical shape. As the depression portion 25*b*, as illustrated in FIG. 4B, a depression portion which has a depth reaching the inside of the protective layer 25 (the depression portion 25*b* located in the center in FIG. 4B), or a depression portion which penetrates through the protective layer 25 in a thickness direction (the depression portion 25*b* located on the right side in FIG. 4B) is included. A plurality of the depression portions 25*b* may not be necessarily provided.

The depth of the depression portion 25*b* from the surface 25*a* of the protective layer 25 can be exemplified in a range of 1 to 15 μm. The diameter of the depression portion 25*b* can be exemplified in a range of 5 to 300 μm, in a plan view. As the diameter of the depression portion 25*b*, the diameter of the approximate circle along the contour of the depression portion 25*b* may be measured.

The depression portion 25*b* is disposed dispersedly in the entire region of the protective layer 25. Here, for convenience, the protective layer 25 is divided in three regions to be described below. A first region E1 is a region where the region provided with the heat generating sections 9 extends in the main scanning direction. A second region E2 is a region located on the upstream side of the heat generating section 9 in a conveyance direction S of the recording medium (Hereinafter, referred to as the conveyance direction S). A third region E3 is a region located on the downstream side of the heat generating section 9 in the conveyance direction S. The depression portion 25*b* is disposed dispersedly in each of the first region E1, the second region E2, and the third region E3.

The particles 16 are disposed in the depression portion 25*b* of the protective layer 25 to be provided in the deeper position than the surface 25*a* of the protective layer 25 located around the depression portion 25*b*. In addition, part of the particles 16 is embedded in the protective layer 25. Further, part of the particles 16 includes a portion 16*d* positioned inside the insulating layer 20.

The particles 16 have a particle size of 5 to 300 μm and are formed of metal (including an alloy of a plurality of metals). The particles 16 are formed of the same material as the material forming the protective layer 25, such as Ti, Al, and Pb, so that it is possible to make a coefficient of thermal expansion of the particle 16 close to a coefficient of thermal expansion of the protective layer 25, thereby reducing stress generated in the protective layer 25.

The particles 16 include a first particle 16*a*, a second particle 16*b*, and a third particle 16*c*.

The particle 16*a* is disposed in the first region E1. The first particle 16*a* is disposed to overlap with the heat generating section 9 in a plan view. The first particle may be disposed between the heat generating sections 9 in the first region E1 or only a part of the first particle 16*a* may be disposed on the heat generating section 9.

The second particle 16*b* is disposed in the second region E2. The second particle 16*b* is disposed to overlap with the discrete electrode 19 in a plan view. The second particle may be disposed between the discrete electrodes 19 in the second region E2 or only a part of the second particle 16*b* may be provided on the discrete electrode 19.

The third particle 16*c* is disposed in the third region E3. The third particle 16*c* is disposed to overlap with a lead part 17*c* in a plan view. The third particle may be disposed between the lead parts 17*c* in the third region E3 or only a part of the third particle 16*c* may be disposed on the lead part 17*c*. In addition, the third particle 16*c* may be disposed on a main wiring portion 17*a* of the common electrode 17 (see FIG. 2) or on a sub-wiring portion 17*b* (see FIG. 2).

On an upper surface of the particle 16, an oxide layer 18 is disposed. The oxide layer 18 can be formed by oxidizing a surface of the particle 16, for example, when using the particle of Ti as the particle 16, $TiO_2$ can be used to form the oxide layer. The oxide layer 18 can have a thickness of 1 to 20 nm. The outer shape of the oxide layer 18 is the same as the outer shape of the depression portion 25*b* in a plan view.

A surface 18*a* of the oxide layer 18 is exposed to the outside and is located in a deeper position of the depression portion 25*b* than the surface 25*a* of the protective layer 25 around the depression portion 25*b*. In other words, the surface 18*a* of the oxide layer 18 is positioned closer to the substrate 7 than the surface 25*a* of the protective layer 25 around the depression portion 25*b*. That is, the surface 18*a* of the oxide layer 18 is disposed below the surface 25*a* of the protective layer 25. A step between the surface 18*a* of the oxide layer 18 and the surface 25*a* of the protective layer 25 (hereinafter, referred to as a step) can be set to 0.1 to 1 μm.

As described above, the thermal head X1 according to the embodiment includes the depression portion 25*b* on the surface 25*a* of the protective layer 25, includes the metal particles 16 in the depression portion 25*b*, and includes the oxide layer 18 on the surface of the particle 16. In addition, the surface 18*a* of the oxide layer 18 is exposed to the outside and is located in a deeper position of the depression portion 25*b* than the surface 25*a* of the protective layer 25 around the depression portion 25*b*. The thermal head X1 having the configuration described above can reduce the occurrence of sticking. The mechanism will be explained below.

First, when the step between the surface 25*a* of the protective layer 25 and the surface 18*a* of the oxide layer 18 is large, and a recording medium is not in contact with the surface 18*a* of the oxide layer 18, the contact area between the recording medium and the protective layer 25 is small, thereby reducing the occurrence of sticking.

As the thermal head X1 is used, the step between the surface 25*a* of the protective layer 25 and the surface 18*a* of the oxide layer 18 becomes small due to abrasion of the surface 25*a* of the protective layer 25. Therefore, the recording medium comes into contact with the oxide layer 18. When the recording medium P comes into contact with the oxide layer 18, the oxide layer 18 is scraped to generate abrasive powder. Since the abrasive powder existing between the recording medium P and the thermal head X1 functions as a lubricant, it is possible to reduce the occurrence of sticking.

When abrasion of the surface 18*a* of the oxide layer 18 progresses larger than the abrasion of the surface 25*a* of the protective layer 25, and the step between the surface 25*a* of the protective layer 25 and the surface 18*a* of the oxide layer 18 becomes large again, the surface 18*a* of the oxide layer 18 is not contact with the recording medium. At this time, the contact area between the recording medium and the protective layer 25 is small, and thus it is possible to reduce the occurrence of sticking.

In addition, when the oxide layer 18 disappears due to abrasion, the surface of the particle 16 is oxidized by coming into contact with air, and the oxide layer 18 is formed on the surface of the particle 16 again.

As described above, the thermal head X1 according to the embodiment can reduce the occurrence of sticking over a long period.

Further, since the surface 18*a* of the oxide layer 18 is positioned closer to the substrate 7 than the surface 25*a* of the protective layer 25, the surface 18*a* of the oxide layer 18 is less likely to come into contact with the recording medium P more than necessary. Therefore, the oxide layer 18 and the particles 16 are less likely to be abraded.

In addition, the thermal head X1 according to the embodiment, the depression portion 25*b* penetrates through the protective layer 25, and part of the particles 16 may be positioned inside the insulating layer 20. When such a configuration is satisfied, an anchor effect occurs, and the bonding strength between the protective layer 25 and the insulating layer 20 can be improved. As a result, even if an external force is applied to the protective layer 25 due to contact friction with the recording medium or the like, peeling is less likely to occur in the protective layer 25.

In addition, in the thermal head X1 according to the embodiment, the first particle 16*a* may be disposed to overlap with the heat generating section 9 in a plan view. When such a configuration is satisfied, it is possible to promote the oxidation of the first particle 16*a* by the heat generation of the heat generating section 9 and to facilitate the formation of the oxide layer 18. Particularly, since the heat generating section 9 is a portion where the recording medium is strongly pressed, sticking can be less likely to occur by disposing the first particle 16*a* in that portion.

In the thermal head X1 of the embodiment, the thermal conductivity of the particles 16 may be greater than the thermal conductivity of the protective layer 25. When such a configuration is satisfied, the heat of the heat generating section 9 can be efficiently transmitted to the recording medium P. As a result, the thermal efficiency of the thermal head X1 can be improved.

Further, in the thermal head X1 of the embodiment, a value (B/A) obtained by dividing B by A may be greater than 0.001, in which A denotes an area of the heat generating section 9 in a plan view, and B denotes an area of a portion of the particles 16 overlapping with the heat generating section 9 in a plan view. When such a configuration is satisfied, it is possible to reduce the contact area between the recording medium and the protective layer 25 on the heat generating section which is a portion where the recording medium is strongly pressed and to increase the amount of abrasive powder generated from the oxide layer 18, whereby it is possible to effectively reduce the occurrence of sticking.

Since the thermal conductivity of the particles 16 is different from the thermal conductivity of the protective layer 25 (in many cases, being higher than the thermal conductivity of the protective layer 25), when too many particles 16 are present on the heat generating section 9, the heat transfer from the heat generating section 9 to the recording medium becomes difficult as expected. Consequently, density unevenness may occur in the printed matter.

In the thermal head X1 of the embodiment, the value (B/A) obtained by dividing B by A may be smaller than 0.2, in which A denotes an area of the heat generating section 9 in a plan view, and B denotes an area of the portion of the particles 16 overlapping with the heat generating section 9 in a plan view. When such a configuration is satisfied, it is possible to reduce the occurrence of the density unevenness.

The area A of the heat generating section 9 in a plan view can be calculated by taking a photograph of the heat generating section 9 from the upper side in a thickness direction using an optical microscope and measuring a length of the corresponding portion in the taken photograph. This is also applied to the area B of the portion of the particles 16 overlapping with the heat generating section 9 in a plan view. The areas may be measured by image processing of the taken photograph.

In the thermal head X1 of the embodiment, the second particles 16*b* may be disposed on the upstream side in a conveyance direction S of the heat generating section 9. When such a configuration is satisfied, abrasive powder generated due to abrasion of the oxide layer 18 can be supplied to the heat generating section 9 where the recording medium is strongly pressed, in association with the transfer of the recording medium. Thus, the occurrence of sticking can be effectively reduced.

The insulating layer 20 and the protective layer 25 can be formed by, for example, the following method.

Masking is performed on the substrate 7 on which various electrodes are patterned, and the insulating layer 20 is formed by a sputtering method. Next, the protective layer 25 is formed by a sputtering method using the same mask. The insulating layer 20 and the protective layer 25 may be formed by an ion plating method, or the insulating layer 20 and the protective layer 25 may be continuously formed.

The particles 16 can be contained in the protective layer 25 by, for example, plasma spraying or arc spraying after or during the formation of the protective layer 25. In addition, since the particles 16 are contained in the protective layer 25 by spraying, the particles can be randomly dispersed in the protective layer 25. In this way, when the formation of the protective layer 25 and the plasma spraying are simultaneously or alternately performed, the protective layer 25 containing the particles 16 can be manufactured.

In the embodiment described above, an example in which the insulating layer 20 and the protective layer 25 are provided is shown, but the insulating layer 20 may not be necessarily provided. Further, the insulating layer 20 or the protective layer 25 may be multilayered.

Figure 5:
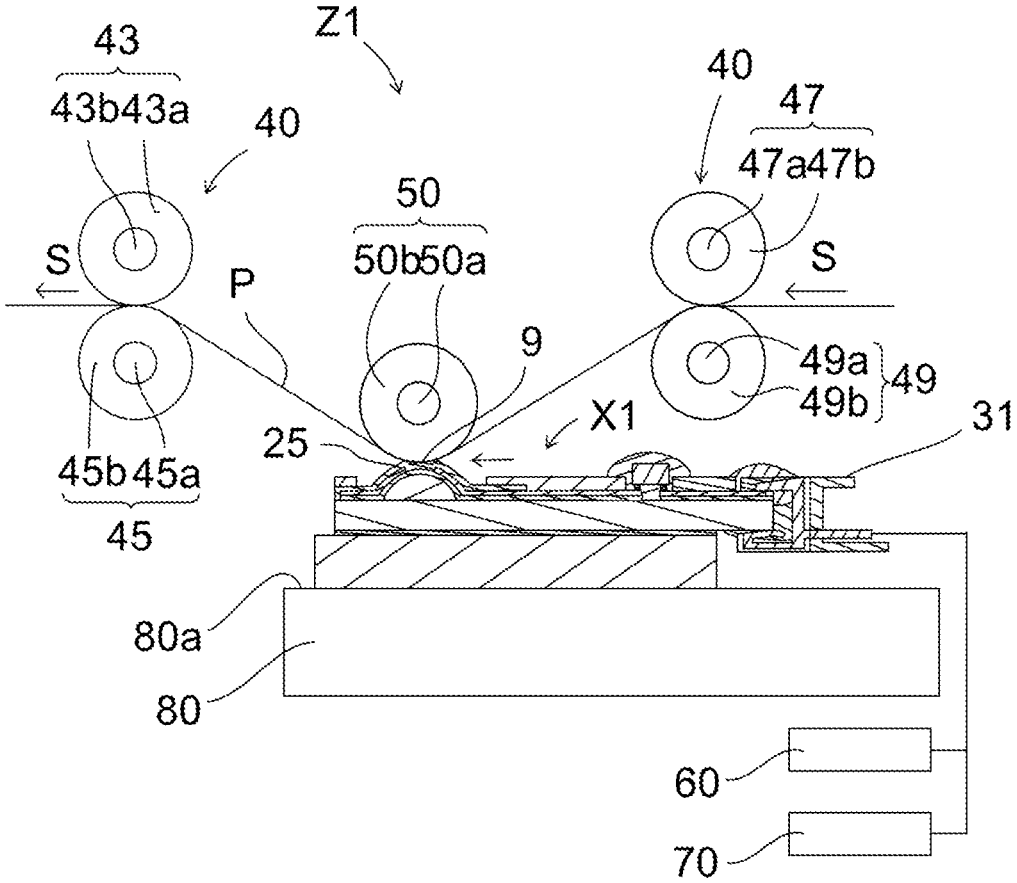
FIG. 5 is a schematic view illustrating a thermal printer according to the first embodiment.

A thermal printer Z1 including the thermal head X1 will be described below with reference to FIG. 5.

The thermal printer Z1 according to the embodiment comprises: the thermal head X1 described above; a conveyance mechanism 40; a platen roller 50; a power supply device 60; and a control unit 70. The thermal head X1 is attached to a mounting face 80*a* of a mounting member 80 disposed in a housing (not shown) for the thermal printer Z1. The thermal head X1 is mounted on the mounting member 80 so as to be oriented along the main scanning direction which is perpendicular to a conveying direction S.

The conveyance mechanism 40 comprises a driving section (not shown) and conveying rollers 43, 45, 47 and 49. The conveyance mechanism 40 serves to convey the recording medium P such as thermal paper or ink-transferable image-receiving paper, in a direction indicated by the arrow S shown in FIG. 5 so as to move the recording medium P onto the protective layer 25 located on the plurality of heat generating sections 9 of the thermal head X1. The driving section functions to drive the conveying rollers 43, 45, 47 and 49, and, for example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber, for example. When using ink-transferable image-receiving paper or the like as the recording medium P, the recording medium P is conveyed together with an ink film (not shown) which lies between the recording medium P and the heat generating section 9 of the thermal head X1.

The platen roller 50 functions to press the recording medium P against the top of the protective layer 25 located on the heat generating section 9 of the thermal head X1. The platen roller 50 is disposed so as to extend along a direction perpendicular to the conveying direction S, and is fixedly supported at ends thereof so as to be rotatable while pressing the recording medium P against the top of the heat generating section 9. For example, the platen roller 50 may be composed of a cylindrical shaft body 50*a* formed of metal such as stainless steel covered with an elastic member 50*b* formed of butadiene rubber, for example.

The power supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

The thermal printer Z1 performs predetermined printing on the recording medium P by, while pressing the recording medium P against the top of the heat generating section 9 of the thermal head X1 by the platen roller 50, conveying the recording medium P onto the heat generating section 9 by the conveyance mechanism 40, and also operating the power supply device 60 and the control unit 70 so as to enable the heat generating sections 9 to selectively generate heat. When using image-receiving paper or the like as the recording medium P, printing on the recording medium P is performed by thermally transferring the ink of the ink film (not shown), which is conveyed together with the recording medium P, onto the recording medium P.

Second Embodiment

Figure 6A:
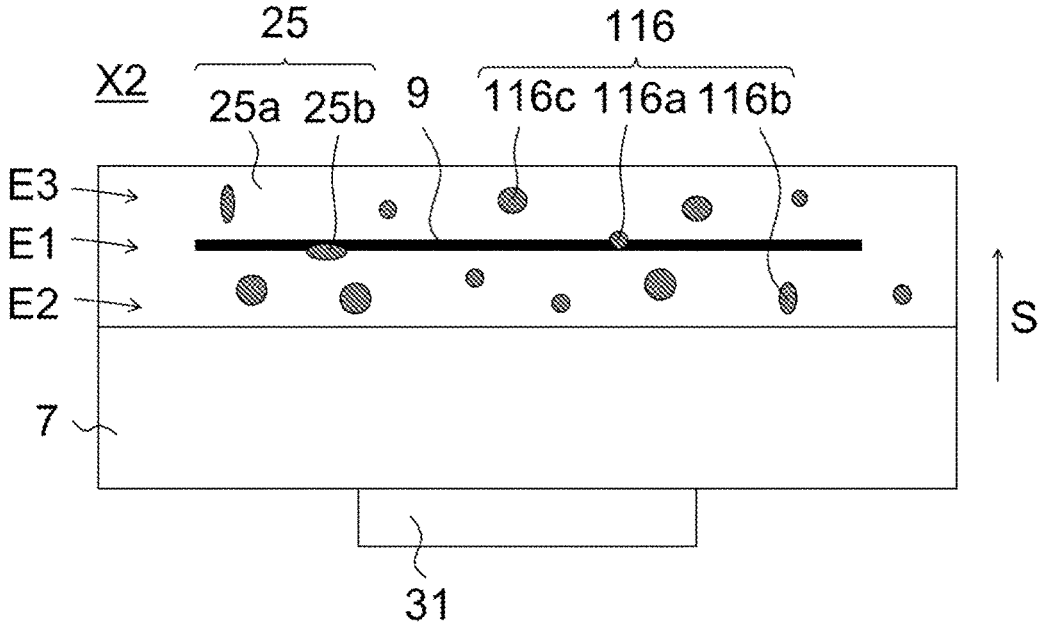
FIG. 6A is a plan view illustrating a schematic configuration of a thermal head according to a second embodiment.

A thermal head X2 will be described with reference to FIGS. 6A and 6B. In FIG. 6A, illustration of the oxide layer 118 is omitted. The same members as those of the thermal head X1 of the first embodiment are denoted by the same reference numerals, and the description thereof will not be repeated. Particles 116 and an oxide layer 118 of the thermal head X2 differ from the particles 16 and the oxide layer 18 of the thermal head X1.

The particles 116 include first particles 116*a*, second particles 116*b*, and third particles 116*c*. The first particles 116*a* are disposed in a first region E1. The second particles 116*b* are disposed in a second region E2. The third particles 116 are disposed in a third region E3.

The sum of areas of the second particles 116*b* in a plan view may be greater than the sum of areas of the third particles 116*c* in a plan view. When such a configuration is satisfied, abrasive powder generated due to abrasion of the oxide layer 118 can be supplied to the first region E1 having a high pressing force of the platen roller 50 (see FIG. 5). As a result, sticking is less likely to occur.

The sum of areas in a plan view can be measured by, for example, taking an image of the surface of the thermal head X1 with a laser microscope and subjecting the taken image to image processing.

It is noted that the sum of the areas of the second particles 116*b* in a plan view is obtained by adding an overlapped portion of the second particles 116*b* located partly in the second region E2 to the sum of the areas of the second particles 116*b* located in the second region E2. This is also applied to the sum of the areas of the third particles 116*c* in a plan view.

Figure 6B:
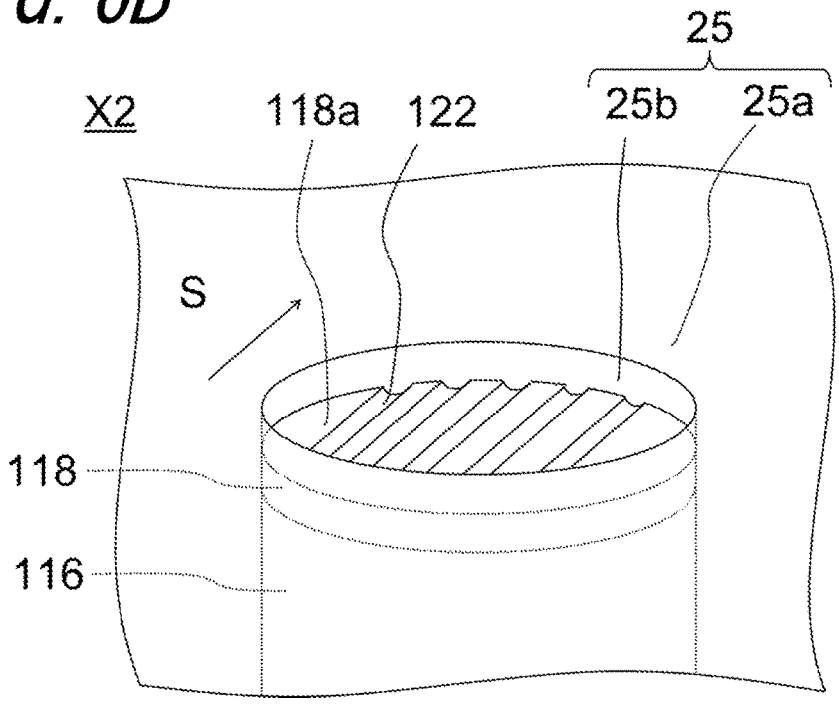
FIG. 6B is an enlarged perspective view illustrating the vicinity of a depression portion of a protective layer of the thermal head according to the second embodiment.

As illustrated in FIG. 6B, a surface 118*a* of the oxide layer 118 may include a plurality of grooves 122 along the conveyance direction S. When such a configuration is satisfied, there is a gap corresponding to the groove 122 between the recording medium p (see FIG. 5) and the surface 118*a* of the oxide layer 118. As a result, the recording medium P can be less likely to stick to the surface 118*a* of the oxide layer 118.

In addition, the groove 122 may have a long shape in the conveyance direction S. When such a configuration is satisfied, abrasive powder peeled off by contact with the recording medium P (see FIG. 5) can flow along the groove 122, and the abrasive powder can be efficiently supplied in the conveyance direction S. As a result, the abrasive powder serves as a lubricant, and thus sticking is less likely to occur.

A width of the groove 122 can be, for example, 0.1 to 10 μm. For example, the groove 122 can be manufactured by conveying a forming member having projections and depressions in the conveyance direction S like the recording medium P.

The thermal head of the present disclosure is not limited to the above-described embodiments, and various modifications and variations are possible without departing from the scope of the invention. For example, although the thermal printer Z1 employing the thermal head X1 according to the first embodiment has been shown herein, it is not intended to be limiting of the invention, and thus, the thermal head X2 may be adopted for use in the thermal printer Z1. Moreover, the thermal heads X1 and X2 according to a plurality of embodiments may be used in combination.

For example, although the thin-film head having the thin heat generating section 9 obtained by forming the electrical resistance layer 15 in thin-film form has been described as exemplification, the invention is not limited to this. The invention may be embodied as a thick-film head having a thick heat generating section 9 by patterning various electrodes and subsequently forming the electrical resistance layer 15 in thick-film form.

Moreover, although a flat-type head in which the heat generating section 9 is formed on the first surface 7*f* of the substrate 7 has been described as exemplification, the invention may be embodied as an edge-type head in which the heat generating section 9 is disposed on an end face of the substrate 7.

Further, the heat storage layer 13 may have a base portion 13 in a region other than a bulge portion 13*a* thereof. The heat generating section 9 may be configured by forming the common electrode 17 and the discrete electrode 19 on the heat storage layer 13, and thereafter forming the electrical resistance layer 15 only in a region between the common electrode 17 and the discrete electrode 19.

The sealing member 12 may be formed of the same material as the hard coat 29 for coating the driving ICs 11. In this case, when the hard coat 29 is printed, the hard coat 29 and the sealing member 12 may be simultaneously formed by performing printing also in a region where the sealing member 12 is formed.

Further, although the example in which the connector 31 is directly connected to the substrate 7 has been described, flexible printed circuits (FPC) may be connected to the substrate 7.

Examples

The following experiment was performed to investigate the relation between the area of the heat generating section in a plan view and the area of the portion of the particles overlapping with the heat generating section in a plan view.

A plurality of substrates were prepared serving as samples on which various electrode wirings such as the common electrode 17, the discrete electrode 19, and the first connection electrode 21 were formed, and an insulating layer 20 of SiN was deposited to a thickness of 5 μm by a sputtering method. Next, a protective layer 25 of TiN was deposited to a thickness of 10 μm by an ion plating method. Subsequently, the particles 16 were contained in the protective layer 25 by plasma spraying so as to obtain values indicated in Table 1.

Next, the driving ICs 11 were mounted on the substrate on which the protective layer 25 was deposited, thereby manufacturing the thermal head, and the following running test was performed.

In a thermal printer mounted with the thermal heads of sample Nos. 1 to 7, printing of 1000 mm was performed on a sheet of thermal paper using as a recording medium with all heat generating elements of an ON-state under a condition of a conveying speed of 50 mm/s. The printed sheet of thermal paper was checked; when a print skipping did not occur, a symbol "A" was indicated in Table 1, and when the print skipping occurred, it was determined that sticking occurred, and a symbol "B" was indicated in Table 1.

In addition, the reflectance of the sheet of thermal paper was measured using an optical densitometer. The reflectance was arbitrarily measured at five points in a sub-scanning direction; when a difference between the maximum value and the minimum value of the measured optical density value was 0.2 or more, it was determined that unevenness of printing density did not occur, and a symbol "A" was indicated in Table 1, and when the difference between the maximum value and the minimum value of the measured optical density value was 0.2 or less, it was determined that unevenness of printing density occurred, and a symbol "B" was indicated in Table 1.

TABLE 1

| Sample No. | B/A | Occurrence of Sticking | Unevenness of Printing Density |
|---|---|---|---|
| No. 1 | 0.0012 | A | A |
| No. 2 | 0.003 | A | A |
| No. 3 | 0.02 | A | A |
| No. 4 | 0.09 | A | A |
| No. 5 | 0.19 | A | A |
| No. 6 | 0.0008 | B | A |
| No. 7 | 0.022 | A | B |

Reduction in the occurrence of sticking could be confirmed in all the thermal printers mounted with the thermal heads of sample Nos. 1 to 7 compared with the thermal printer mounted with the thermal head according to the related art.

In more detailed confirmation, as indicated in Table 1, the sticking did not occur in sample Nos. 1 to 5 and 7 in which the value of B/A was greater than 0.0012. In contrast, the sticking slightly occurred in sample No. 6 in which the value B/A was 0.0008.

As indicated in Table 1, the unevenness of printing density did not occur in sample Nos. 1 to 6 in which the value B/A is smaller than 0.02. In contrast, the unevenness of printing density slightly occurred in sample No. 7 in which the value B/A was 0.022.

REFERENCE SIGNS LIST

X1-X2: Thermal head
Z1: Thermal printer
E1: First region
E2: Second region E3: Third region
1: Heat dissipating plate
3: Head base body
7: Substrate
9: Heat generating section
11: Driving IC
12: Sealing member
13: Heat storage layer
14: Bonding member
16, 116: Inorganic particle
16*a*, 116*a*: First particle
16*b*, 116*b*: Second particle
16*c*, 116*c*: Third particle
18, 118: Oxide layer
18*a*, 118*a*: Surface
20: Insulating layer
25: Protective layer
25*a*: Surface
25*b*: Depression portion
27: Cover layer
31: Connector
122: Groove

The invention claimed is:

1. A thermal head, comprising:
a substrate;
a heat generating section disposed on the substrate;
an electrode which is disposed on the substrate and is connected to the heat generating section;
a protective layer covering the heat generating section and the electrode, the protective layer having a first surface including a hole with an opening;
at least one particle of metal disposed inside the hole; and
an oxide layer covering the at least one particle, composed of oxides of the metal, and comprising
a second surface that is exposed and that is below the opening.

2. The thermal head according to claim 1, further comprising:
an insulating layer disposed between the heat generating section and the protective layer, and between the electrode and the protective layer,
wherein the hole penetrates through the protective layer, and
a part of the at least one particle is positioned inside the insulating layer.

3. The thermal head according to claim 1, wherein the at least one particle is positioned to overlap with the heat generating section in a plan view of the thermal head.

4. The thermal head according to claim 3, wherein a thermal conductivity of the at least one particle is greater than a thermal conductivity of the protective layer.

5. The thermal head according to claim 3, wherein a value of B/A is greater than 0.001, in which A denotes an area of the heat generating section in a plan view of the thermal head, and B denotes an area of a portion of the at least one particle overlapping with the heat generating section in a plan view of the thermal head.

6. The thermal head according to claim 5, wherein the value of B/A is less than 0.2.

7. The thermal head according to claim 1, wherein the at least one particle is disposed on an upstream side of the heat generating section in a conveyance direction of a recording medium.

8. The thermal head according to claim 7, wherein the at least one particle comprises a plurality of particles,
the plurality of particles includes
first particles positioned on an upstream side of the heat generating section in the conveyance direction of the recording medium, and
second particles positioned on a downstream side of the heat generating section in the conveyance direction of the recording medium, and
a sum of areas of the first particles in a plan view of the thermal head is greater than a sum of areas of the second particles in a plan view of the thermal head.

9. The thermal head according to claim 1, wherein the second surface comprises a plurality of depression portions.

10. The thermal head according to claim 9, wherein the plurality of depression portions have a long shape extending in a conveyance direction of a recording medium.

11. A thermal printer, comprising:
the thermal head according to claim 1;
a conveyance mechanism which conveys a recording medium to pass over the heat generating section; and
a platen roller which presses the recording medium.

* * * * *